US006612574B1

(12) United States Patent
Cole et al.

(10) Patent No.: US 6,612,574 B1
(45) **Date of Patent: *Sep. 2, 2003**

(54) GAMING DEVICE AND METHOD OF PLAYING A GAME

(75) Inventors: Joseph W. Cole, Las Vegas, NV (US); Elia Rocco Tarantino, Las Vegas, NV (US)

(73) Assignee: Colepat, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/572,711

(22) Filed: May 16, 2000

(51) Int. Cl.[7] ..... A63B 71/00

(52) U.S. Cl. ..... 273/138.1; 273/142; 273/143; 463/17; 463/20; 463/21; 463/22

(58) Field of Search ..... 463/20, 17, 21, 463/22; 434/161, 176, 157; 273/143 R, 142

(56) References Cited

U.S. PATENT DOCUMENTS

| | | | |
|---|---|---|---|
| 3,281,149 | A | 10/1966 | Miller |
| 4,200,291 | A | 4/1980 | Hooker |
| 4,570,934 | A | 2/1986 | Smyth |

(List continued on next page.)

FOREIGN PATENT DOCUMENTS

| | | | |
|---|---|---|---|
| DE | 2911710 | A1 | 10/1980 |
| DE | 2938307 | A1 | 4/1981 |
| DE | 3700861 | A1 | 7/1988 |
| EP | 0464935 | | 1/1992 |
| FR | 1474617 | | 3/1967 |
| GB | 1242298 | | 8/1971 |
| GB | 2062923 | * | 5/1981 |
| GB | 2066991 | | 7/1981 |
| GB | 2072395 | | 9/1981 |
| GB | 2083936 | | 3/1982 |
| GB | 2084371 | | 4/1982 |
| GB | 2096376 | | 10/1982 |
| GB | 2137392 | | 10/1984 |
| GB | 2201821 | | 9/1988 |
| GB | 2202964 | | 10/1988 |
| JP | 05131044 | | 5/1993 |
| JP | 405154230 | | 6/1993 |

OTHER PUBLICATIONS

*An Illustrated Price Guide To The 100 Most Collectible Trade Stimulators* By: Richard M. Bueschel; pp. 21, 29, 83; Published in U.S., 1978.

*Slots 1* By: Richard M. Bueschel; pp. 136, 142; Published in U.S., 1978, Revised in 1981 and 1988.

*Slot Machines on Parade* By: Robert N. Geddes; p. 128; Published in U.S. Oct. 1980.

*Slot Machines* By: Marshall Fey; pp. 126, 150; Published in Reno, Nevada in 1983. 2nd 1989, 3rd 1991.

Cover and pp. 91, 101 of *Intergame Magazine*, Published in England in Jun. 1995.

*Primary Examiner*—Benjamin H. Layno
*Assistant Examiner*—Dolores R. Collins
(74) *Attorney, Agent, or Firm*—Weide & Miller, Ltd.

(57) ABSTRACT

A game having a bonus feature and a gaming apparatus for presenting the game are disclosed. One embodiment of the method comprises the steps of a player placing a wager, spinning a plurality of first reels having indicia thereon, determining if indicia displayed by the plurality of first reels associated with a first pay line comprises a predetermined winning combination, and if so, paying a first award and then associating that first award with at least one bonus reel, spinning the at least one bonus reel, and determining if an award associated with the at least one bonus reel is associated with a second pay line, and if so, paying a bonus award. In one embodiment, the gaming device includes three first mechanical or video-generated reels for playing the first game, one second mechanical or video-generated reel for playing the bonus event, and associated mechanisms for accepting wagers, paying winnings, and associating win amounts from the first game with the at least one bonus reel.

17 Claims, 3 Drawing Sheets

U.S. PATENT DOCUMENTS 4,695,053 A * 9/1987 Vazquez, Jr. et al. ... 273/143 R
4,756,531 A * 7/1988 DiRe et al. ..... 273/138 A
4,805,907 A 2/1989 Hagiwara
4,836,546 A * 6/1989 DiRe et al. ..... 273/138 A
4,871,171 A 10/1989 Rivero
5,067,712 A 11/1991 Georgilas
5,205,555 A 4/1993 Hamano
5,259,616 A 11/1993 Bergmann
5,342,049 A 8/1994 Wichinsky et al.
5,344,145 A 9/1994 Chadwick et al.
5,393,057 A 2/1995 Marnell, II
5,397,125 A * 3/1995 Adams ..... 273/138 A
5,722,891 A * 3/1998 Inoue ..... 463/20
5,788,573 A 8/1998 Baerlocher et al.
5,823,874 A * 10/1998 Adams ..... 463/17
5,848,932 A * 12/1998 Adams ..... 463/20
5,911,418 A 6/1999 Adams
5,976,016 A 11/1999 Moody et al.
6,033,307 A * 3/2000 Vancura ..... 463/20
6,089,978 A * 7/2000 Adams ..... 463/20
6,135,884 A 10/2000 Hedrick et al.

* cited by examiner 22
24
24
24
44
40
WIN ALL
48
25

22
24
24
24
44
40
WIN ALL
48
25
10
WINNER PAID 10 CREDITS
42

22
24
24
24
44
40
WIN ALL
48
25
50
WINNER PAID 50 CREDITS
42

22
24
24
24
44
40
10
48
50
25

GAMING DEVICE AND METHOD OF PLAYING A GAME

FIELD OF THE INVENTION

The present invention relates to games and gaming devices arranged to present games for play.

BACKGROUND OF THE INVENTION

Gaming is an industry which has grown immensely in the last few decades. This growth has seen gaming spread from just a few locations to many throughout the world, and has resulted in greater numbers of people than ever participating in gaming. Gaming originally comprised just a few "table" games, such as poker, craps and blackjack. Later, machine based games were offered, such as the now common mechanical reel-type slot machine and the video style slot and poker machine.

One problem facing game manufacturers is the need to continually create new and exciting games to maintain the interest of the public. This is more difficult than it appears at first glance. Of course, to be successful, the new game must appeal to the player to generate a profitable revenue. The gross revenue generated by a game is based on a variety of factors, such the length of time each player plays, the amount wagered, and the average percentage "take" of the game. If the "take" is too high, a player is generally unwilling to play. If the "take" is very low, then it is necessary to ensure that the game is played nearly continuously so that revenue is constantly being derived. When players play a game for only short periods of time, the revenue of the game is generally reduced because of "idle" time between players. The amount wagered also contributes to the revenue. In general, if the amount that a player is willing to bet, either on each game or over time can be increased, then the revenue of the game will generally increase. These and a variety of other factors all contribute to the total revenue produced by a game.

The ability of a game to generate a profit is dependent not only upon the gross revenue produced by the game, but the cost of producing and operating the game device. A game may be very appealing, but if extremely expensive to produce, its revenue may not exceed its costs. Profitability is thus tied to both the cost of the game and the ability of the game to generate revenue.

The appeal of a game and the length of time a player will play a game are dependent upon a number of factors. These factors include some of those described above, such as the odds or take, and on a variety of other factors. For example, a game which is very difficult to understand and play will not tend to draw many long-term players. A few players may take to the game, while most will be alienated and play once or twice. A game which involves little skill may appeal to a wide crosssection of the public because of its ease of play. On the other hand, the length of time a player may play such a game may be fairly short, with the player losing interest unless "luck" is on their side and they see consistent winnings during a session of play.

Thus, it is desirable to produce a game which attracts a wide audience, which keeps the attention of a player for long periods of time, and which causes the player to want to place large wagers.

SUMMARY OF THE INVENTION

The present invention comprises a gaming apparatus and a method of playing a game. More specifically, the invention is a game comprising a main game and an associated bonus event.

One or more embodiments of the invention comprise a gaming apparatus. In one embodiment, the gaming apparatus includes a plurality of first or main game reels for displaying indicia. A spin input is provided by which a player is permitted to spin the first reels. A payout mechanism pays the player a winning in the event a predetermined winning combination of indicia are displayed by the plurality of first reels after the spin.

The gaming apparatus includes at least one additional or bonus reel. The at least one additional reel is adapted to display winning amounts won by the player as a result of playing the game. A spin input is provided by which a player is permitted, at one or more times, to spin the at least one additional reel. The gaming apparatus is arranged to pay the player a winning amount if the result of the spin of the additional, bonus reel comprises a winning outcome.

In one or more embodiments of the invention, one or more of the main game and/or bonus event reels comprise mechanical reels. In other embodiments, one or more of the main game and/or bonus event reels comprise images which are displayed on a display.

One or more embodiments of the invention comprise a method of playing a game. One such method comprises the steps of a player placing a wager, spinning a plurality of first or main game reels having indicia thereon, determining if indicia displayed by the plurality of first reels and associated with a first pay line comprises a predetermined winning combination of indicia, paying a first award if the displayed indicia comprise a predetermined winning combination, associating the first award with at least one additional or bonus reel when a winning combination is received by spinning the first reels, spinning the at least one additional reel, and determining if an award associated with the at least one additional reel is associated with a second pay line, and if so, paying a bonus award.

In one or more embodiments of the invention, the step of associating the first award with the at least one additional reel comprises transferring a winning value from the first game and displaying that value on the at least one additional reel.

In one embodiment, a player is permitted to continue to associate first awards with the additional reel until all positions of the additional reel are full, at which time the player must spin the additional reel. In another embodiment, after the additional reel is full, the player is permitted to continue playing and replace lower value first awards on the additional reel with later received higher value first awards.

In one embodiment, a "win all" indicia is associated with the additional reel. A player receiving the "win all" indicia as a result of a spin of the additional reel is entitled to a winning comprising the sum of all first awards displayed by or associated with the additional reel.

In accordance with the invention, a game is provided in which a player is entitled to play for a bonus winning amount simply as a result of playing the game. The player is not required to place an additional bet in order to be entitled to play for the bonus award on the additional reel. Moreover, a player is enticed to play the first game an extended period of time in order to fill the additional reel and improve the odds of winning the bonus game.

Further objects, features, and advantages of the present invention over the prior art will become apparent from the detailed description of the drawings which follows, when considered with the attached figures.

DESCRIPTION OF THE DRAWINGS

FIG. 3(*b*) illustrates indicia displayed by reels of a game being played in accordance with the invention after another spin of the main game reels, wherein a winning combination was received on the main game reels and an associated winning amount from the first game has been transferred to a bonus reel;

FIG. 3(*c*) illustrates indicia displayed by reels of a game being played in accordance with the invention after a later spin of the main game reels, wherein another winning combination was received on the main game reels and an associated winning amount from the first game has been transferred to the bonus reel; and FIG. 3(*d*) illustrates indicia displayed by reels of a game being played in accordance with the invention after a player has spun the bonus reel and received a bonus win.

DETAILED DESCRIPTION OF THE INVENTION

The invention is a method of playing a game and one or more apparatus for presenting a game for play. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, one aspect of the invention is a game having a secondary event or bonus feature. By a "bonus" feature, it is generally meant that by engaging in a first event or activity, a player is presented at one or more times with an opportunity to engage in an additional, second event or activity. In a preferred embodiment, although the game is considered a single game comprising two parts, both activities of the game primarily comprise events of chance. In one or more embodiments, the bonus event is referred to as a "bonus" event because while the player is required to place a wager to engage in the first or main activity, the player may participate in the bonus event without placing an additional wager.

Figure 1:
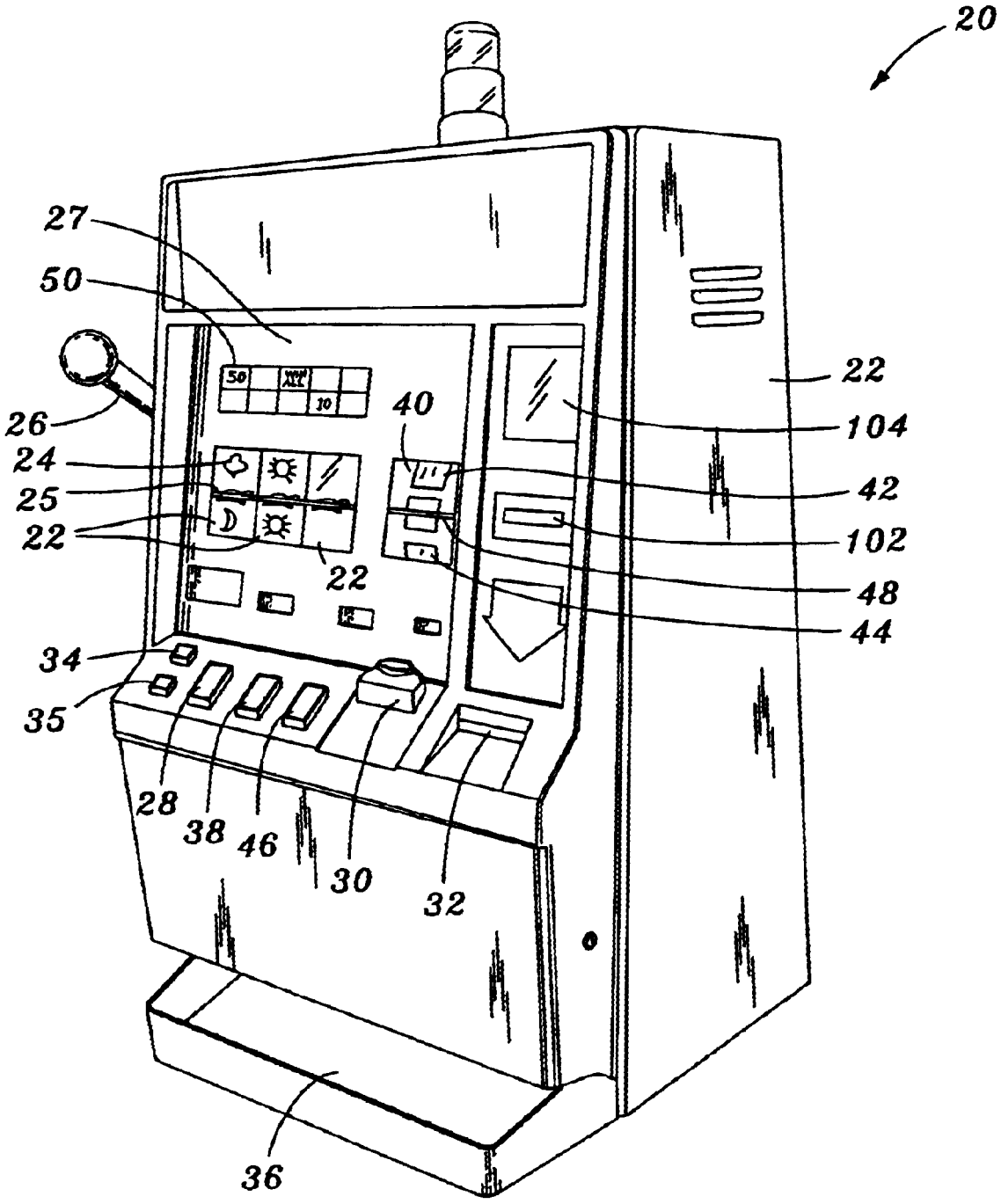
FIG. 1 is illustrates of a gaming apparatus in accordance with an embodiment of the present invention.

FIG. 1 illustrates a gaming apparatus 20 arranged to present a such a game in accordance with one embodiment of the invention. The apparatus 20 may have a variety of forms and configurations. As illustrated, the apparatus 20 includes a cabinet 21 for housing and supporting the systems and apparatus necessary to present the game to a player.

The apparatus 20 includes means for displaying game indicia. In one or more embodiments, this means comprises a plurality of mechanical reels 22. In a preferred embodiment, the reels 22 are utilized in playing a first or main game or event, and as such are referred to generally herein as "main game" reels.

Such reels 22 are well known, and comprise a body having one or more indicia or symbols 24 printed thereon. In a preferred embodiment, three reels 22 are provided. In one or more embodiments, each reel 22 includes twelve indicia positions or locations. The indicia 24 displayed on a particular reel 22 may comprise twelve different indicia, or include one or more duplicate indicia. In addition, the indicia 24 displayed on the reels 22 may be the same or different. The indicia 24 may comprise numbers, letters, pictures, symbols or the like.

Preferably, one or more combinations of the indicia 24 when displayed simultaneously as a result of a spin of the reels 22 are designated as a winning combination of indicia. The number of winning combinations may vary dependent upon the desired payout or winning percentage to the players as compared to that which is retained by the game operator. In one or more embodiments, at least one of the same indicia 24 is contained on each of the reels 22, and at least one winning combination comprises all of the reels 22 displaying that same indicia. For example, with reference to FIG. 1, the at least one indicia 24 which is displayed on each reel 22 comprises an image of a turtle. A winning combination comprises all of the reels 22 displaying the turtle image.

Means are provided for rotating the reels 22. In one or more embodiments, the means may comprise a mechanical linkage associated with a spin arm 26, with movement of the spin arm (a "pull") by a user causing the reels 22 to spin. In such an arrangement, the reels 22 are generally allowed to free- wheel and then stop.

In another embodiment, electronically controlled mechanisms are arranged to rotate and stop each reel 22. Such mechanisms are well known to those of skill in the art. In this arrangement, actuation of the spin arm 26 or depression a spin button 28 causes a controller (not shown) to signal the activation of the spin mechanism associated with one or more of the reels 22. Preferably, the controller is arranged to either turn off the signal to the device(s) effecting the rotation of each or all of the reels 22, or generates a signal for activating a braking device, whereby the reels 22 are stopped. As is well known, the combinations of reel positions and their odds of hitting are associated with the controller, and the controller is arranged to stop the reels 22 in a position displaying a combination of indicia as determined by the controller based on the combinations and odds. The principal of such an arrangement is described in U.S. Pat. No. 4,448,419 to Telnaes, which is incorporated herein by reference.

In a preferred embodiment, each reel 22 is positioned behind a screening glass or panel 27. The panel 27 includes at least one area through which each of the reels 22, and thus the indicia 24 thereon, may be viewed. In order to aid the player in determining which indicia 24 displayed by the reels 22 comprises the indicia which are evaluated for determining if a winning combination has been received, a pay line 25 is provided. The pay line 25 comprises a line or bar which extends over the reels 22. As illustrated, the pay line 25 comprises a line printed on the screening glass aligned over a central portion of each reel 22. When the reels 22 stop rotating, the indicia 24 on each reel 22 which the pay line 25 extends over or intersects comprise the indicia 24 which are evaluated for determining if a winning combination has been received. Of course, the pay line may be imaginary, and a winning combination determined by the controller or the position of the reels.

The gaming apparatus 20 includes a mechanism for accepting a wager. As illustrated, a coin accepting mechanism 30 is provided for accepting coins. A bill acceptor 32 is provided for accepting bills. Other mechanisms may be provided for accepting a wager, such as card or ticket readers or input devices whereby a player may have funds paid from a remote account. A "play credit" 34 button and a "bet max" button 35 may also be provided for permitting a player to place wagers from a pool of credits won or paid by the player. The gaming apparatus 20 may be adapted to accept a variety of coins, such as dimes, quarters or silver dollars. In one or more embodiments, playing a single credit comprises playing an amount of one of the accepted coins, and playing a maximum bet comprises playing or betting an amount comprising a multiple of the value of a single of the accepted coins.

The gaming apparatus 20 includes a means for paying a player winnings. When a player wins a game, the player is preferably paid in the form of stored credits, the amount of which is indicated to the player. A "cash out" button 38 is preferably provided for permitting a player to be paid the winnings or any paid in credits. In one embodiment, the means for paying a player comprises a coin dispenser (not shown) for dispensing coins to a coin tray 36. A player may also be permitted to be paid their credits or winnings on a player card (as described below) in electronic form.

As described above, the gaming apparatus 20 preferably includes a controller (not shown) for controlling the game, including receiving player input and sending output signals for controlling the various components of the apparatus 20. The controller may be arranged to receive input in the form of a "spin" signal from a spin button or the spin arm 26 (or other spin input), a bet credit signal when the bet credit button 34 is depressed, and a credits insert signal when a player inserts bills or coins. The controller may be arranged to send signals for stopping the reels 22, for causing the coin dispenser to pay winnings, and cause a display to display winning amount information. In addition, the controller is preferably arranged to determine if a spin of the main game reels 22 has resulted in a win, and if so, the amount to be payed to the player for that win.

The number of winning combinations, the odds of receiving a winning combination and the payout for each winning combination may vary, as is well known in the art. If the reels are purely mechanical, the odds of winning are based on the number of indicia, the number of reels, and the number of predetermined winning combinations. As described above, when a mechanism is employed for stopping the reels 22 in predetermined positions, the controller may be programmed to present desired odds. It will also be appreciated that a player may be paid more for a winning combination when the player places a larger wager. In this regard, the player may be presented with a pay table which indicates the payout for each winning combination based on the wager placed by the player.

The controller may comprise one or more than one element, and may comprise hardware and/or software, such as code executable by a processor. The code may be stored on an appropriate data storage device, such as a hard drive or memory chip, or be integrated into a micro-processor chip. The controller may be part of an integrated system, or be self-contained. The arrangements of such a controller and the principles of odds, payouts and the like are well known to those of skill in the art.

In accordance with an embodiment of the invention, the gaming apparatus 20 is arranged to present a player with an additional or bonus game or event associated with the first event or main game described above. In a preferred embodiment, the player is presented with the opportunity to participate in a bonus or additional event upon the occurrence of one or more events related to the main game, without being required to place an additional wager, and with the opportunity to win an additional payout separate from any payout awarded by playing the main game. As described below, this second event is referred to as a bonus or additional feature. The event is referred to as a "bonus" event because the player is at one or more times, simply by having played the first or main game, provided the opportunity to win additional winnings without being required to place an additional bet In one or more embodiments, one or more bonus, additional or second reels are provided. Preferably, the one or more additional reels comprise a single, fourth, bonus reel 40. The bonus reel 40 is arranged to display indicia associated with a bonus feature of a game played on the apparatus 20. In a preferred embodiment, the bonus reel 40 is capable of displaying twelve of the same or different indicia 42, and thus has twelve positions or locations.

In a preferred embodiment, the bonus reel 40 is capable of displaying indicia 42 comprising winning amounts or payouts received by a player when playing the first or main game using the main game reels 22. In one or more embodiments, such indicia 42 comprise numeric payout amounts, such as paid credit or winning values. These values are dependent upon the winnings paid in accordance with the play of the main game reels 22. One of the indicia 42 preferably comprises a "win all" indicia 44. In other words, in a preferred embodiment, the bonus reel 40 is capable of displaying twelve (12) indicia 42 including the "win all" indicia 44, i.e. eleven (11) indicia plus the "win all" indicia, and thus includes eleven (11) locations for indicia comprising amounts paid the player for receiving winning combinations when playing the main game. In one or more other embodiments, the "win all" indicia 44 is not included, or other indicia are included which are associated with the bonus reel 40 but not with the main game.

In accordance with an embodiment of the apparatus 20, the player is permitted to, at one or more times, spin the bonus reel 40. Preferably, a separate bonus reel "spin" button 46 or other spin input is provided for this purpose. When the bonus reel spin button 46 is depressed, the bonus reel 40 is caused to spin and then stop, displaying either a blank or unfilled position, or one of the indicia 42 thereon. Preferably, as with the main game reels 22, a pay line 48 is provided for indicating whether an indicia displayed by the bonus reel 40 is a winning indicia.

Means are provided for causing the bonus reel 40 to display winnings paid as a result of play of the main game. In one embodiment, the bonus reel 40 comprises a mechanical reel which is arranged to rotate. Display means are associated with the bonus reel 40 for displaying the indicia 42. In one or more embodiments, LEDs are associated with the bonus reel 40 for displaying the indicia 42. In other embodiments, one or more lasers may be arranged to display images on the reel 40, or the reel 40 may include one or more LCDs or other display devices. Such display devices are arranged so that the bonus reel 40 may still rotate, but the indicia associated therewith may be changed to reflect winning values from the main game, which values may change over time.

In accordance with the invention, LEDs may be arranged to project indicia images onto the bonus reel 40 from behind. A control is provided for selectively activating the LEDs to generate differing images. In one or more embodiments, as described below, the indicia 42 may comprise credit values such as the numbers 10, 20 or the like, and the LEDs may then be arranged to project images of such values.

The bonus reel 40 need not actually display each and every indicia 42 which is associated with it. For example, in an embodiment where the bonus reel 40 is mechanical, only the reel locations facing the player and which are visible need to be capable of displaying indicia. In this arrangement, a large number of indicia 42 may be associated with the bonus reel 40, but only a few of these indicia may be displayed at any given time. Of course, the same is true in that instance where, as described below, the bonus reel 40 comprises a computer generated image.

Those of skill in the art will appreciate that the main game reels 22 and/or the bonus reel 40 may instead comprise one or more electronic displays for displaying information such as the indicia 24,42. For example, in one or more embodiments, an LCD screen may be arranged to display an image comprising the main game reels 22 and the indicia 24 associated therewith, and the bonus reel 40 and the indicia 42 associated therewith.

In a preferred embodiment of the invention, the main game reels 22 comprise rotating mechanical elements, and the bonus reel 40 comprises an electronically displayed image. In such event, the controller for causing the different indicia 42 to be display on the bonus reel 40 comprises a video controller causing the different images to be displayed by the video screen. The video controller may be arranged to cause the image of a "rotating" mechanical reel to be displayed to simulate rotation of a physical reel.

As described above, a variety of the player input devices or controls comprise physical electromechanical buttons. In place of, or in addition to such controls, one or more touch-screen or touch-sensitive displays may be provided. Such screen(s) may be arranged to display information to a player and accept input from the player. For example, the screen may display a "spin" button area which when touched by the player serves to provide a "spin" signal to the controller.

In a preferred embodiment of the invention, the main game reels 22 comprise mechanical reels which are activated by either the spin arm 26 or a spin button comprising a touch screen button.

The bonus reel 40 comprises a video simulated reel which is activated by a touch screen button as well.

In one or more embodiments of the invention, there may be fewer than three or greater than three main or first reels 22. Further, as described above, the number of indicia associated with the reels 22 may vary. There may be more than one additional second or bonus reel 40 as well. For example, two bonus reels may be provided, and winning amounts from the first game may be associated with one or both of the bonus reels. The player may then only receive a bonus winning if the resultant spin of both bonus reels comprises a winning combination. In another embodiment, one of the bonus reels may display other indicia, such as multipliers. Upon a spin of the bonus reels, a player may receive a winning amount based on the outcome of a first of the bonus reels, which amount may be increased by a multiplier depending on the outcome of the spin of the bonus of the bonus reels. There are a wide variety of combinations of such additional reels. In one embodiment, a player may be permitted to spin one of the bonus reels without paying an additional wager, but may be required to place an additional wager in order to spin a multiplier bonus reel or the like.

In one or more embodiments of the invention, the main game may comprise other than a "slot"-type game as described above. For example, the first or main game may comprise video poker or a game in which the player plays the house, such as "21." When the player wins the game, as determined by the criteria for that game, then the player is paid a winning amount. This amount is then associated with the second or bonus event, as described above.

In one or more embodiments, the amounts which are associated with the bonus game need not comprise the actual winning amount(s) from the main game. For example, the amounts associated with the bonus game may comprise a fraction of the winning amount from the main game, such as ½, or may comprise a multiple of the winning amount from the main game, such a 2×, 5×, 10×or the like. In one or more other embodiments, for each win of the main game, an amount may be randomly selected for association with the bonus game. For example, one winning amount from the group comprising 5 credits, 10 credits and 20 credits may be assigned to the bonus event when a player wins the main game.

In one or more embodiments, the winnings paid to a player may comprise other than money. For example, a player may win gifts, such as goods or services. In that event, words or symbols identifying the win may be associated with the bonus reel 40. The gaming apparatus 20 may be arranged to print a ticket by which the player redeems their winnings instead of dispensing the winnings directly.

The bonus event or game need not have the exact format as described above. For example, in one or more embodiments, the bonus event may comprise a Roulette-wheel type game in which the numbers associated with the wheel comprise winning amounts associated with the wheel when won playing the main game.

In accordance with one or more embodiments of the invention, the gaming apparatus 20 may be linked to a central computer or comprise a part of a system. In one embodiment, a plurality of the gaming apparatus 20 are associated with a gaming system. The system may include one or more central computers which receive data from the apparatus 20 and which send data to each apparatus 20.

In one or more embodiments of the invention, the gaming apparatus 20 may be provided with a player card 100. The card 100 may have a variety of features. In one or more embodiments, the card 100 may comprise a player tracking card as is known in the art. In this regard, the card 100 may be used to store player identification information or an identification code associated with player information stored elsewhere. For example, a gaming establishment may reward players for their play and continued play over time. When the player begins playing a game in accordance with the invention, the player may insert their card 100 into a card reader 102 or similar device associated with the gaming apparatus 102. The information associated with the card 100 is transferred to the gamine system for use by the gaming establishment. In addition, the information may be transferred to the card 100 and stored thereon. The gaming establishment may provide awards, such as food or money, to reward a player for their play. The awards may be based upon a number of points generated by a player associated with their play, such as the length of time of play. The gaming establishment may update the points awarded to a player at the end of each gaming session in which the player participates.

In a preferred embodiment of the invention, the card 100 has information associated therewith which causes the gaming apparatus 20 to specially configure itself for a particular player. In one or more embodiments, the card 100 has information associated therewith which comprises a language code which is utilized by the gaming apparatus 20 to specifically configure the game presented. In a preferred embodiment, the language code is utilized to cause the gaming machine 20 to display information in a particular language.

In one or more embodiments, a number of language codes are provided, each code associated with a particular language, such as English, Spanish, German or the like. When the code is read by the gaming apparatus 20, the apparatus 20 is arranged to display certain information in the particular language associated with the code. The information which is displayed in the language may vary. In one embodiment, the gaming apparatus 20 includes a display 104 which displays instructions, game status and other information to the player. The information which is displayed by this display 104 may be displayed in the particular language associated with the code.

Of course, other information may also be displayed in accordance with the particular code. For example, a changeable display may be associated with one or more of the buttons such as the bet credit button 34 or the bet max button 35, the information displayed on which is changed dependent upon the code. The indicia which are displayed by the reels may also be changed.

In one or more embodiments, the card 100 comprises substrate of plastic or similar material having a magnetic stripe for storing information. Of course, a variety of media may be used to store the information. The card 100 may have information printed, encoded or otherwise associated therewith. In addition, it is not necessary that a card be used. An encoded chip, or a token, paper slip, pass, or other media may be used.

In one or more other embodiments, a particular language code is not associated directly with the media, such as the card 100, but is instead stored at the gaming apparatus 20 or a computer or similar device which the apparatus 20 is in communication with. For example, a player identifier may be stored on the card 100, and a data file may be stored on a central computer which corresponds to that player identifier. That data file may contain a particular language code. When the player inserts their card, the gaming device 20 may utilize the player identification information to access the language code for that player from the database. In this arrangement, the means by which a player identifies themselves need not comprise an independent media, but may comprise a biometric identifier. Such may comprise fingerprints, retinal images or the like.

In one or more embodiments, the gaming apparatus 20 is adapted to specially configure itself in other than, or in addition to, just changing the language of displayed information. For example, the gaming apparatus 20 may be adapted to accept foreign money and provide monetary conversion information to the player.

As described above, the gaming apparatus 20 includes a card acceptor 102. The card acceptor 102 comprises a card reader for reading information from the card. The particular means for reading the information may vary dependent upon the manner by which the information is associated with the card. For example, a magnetic stripe reader is used to read information from a magnetic stripe. An optical reader may be used to read printed information. Retinal and fingerprint scanners are used to image retinas and fingerprints. In one or more embodiments, the gaming apparatus 20 may include more than one type of reading device.

Play of a game in accordance with the present invention will now be described. In one or more embodiments, the game is presented for play on an apparatus 20 such as that illustrated in FIG. 1, and reference is made herein to such an apparatus. Of course, a game played in accordance with the invention may be presented on a wide variety of gaming devices other than that specifically illustrated and described herein.

Figure 2:
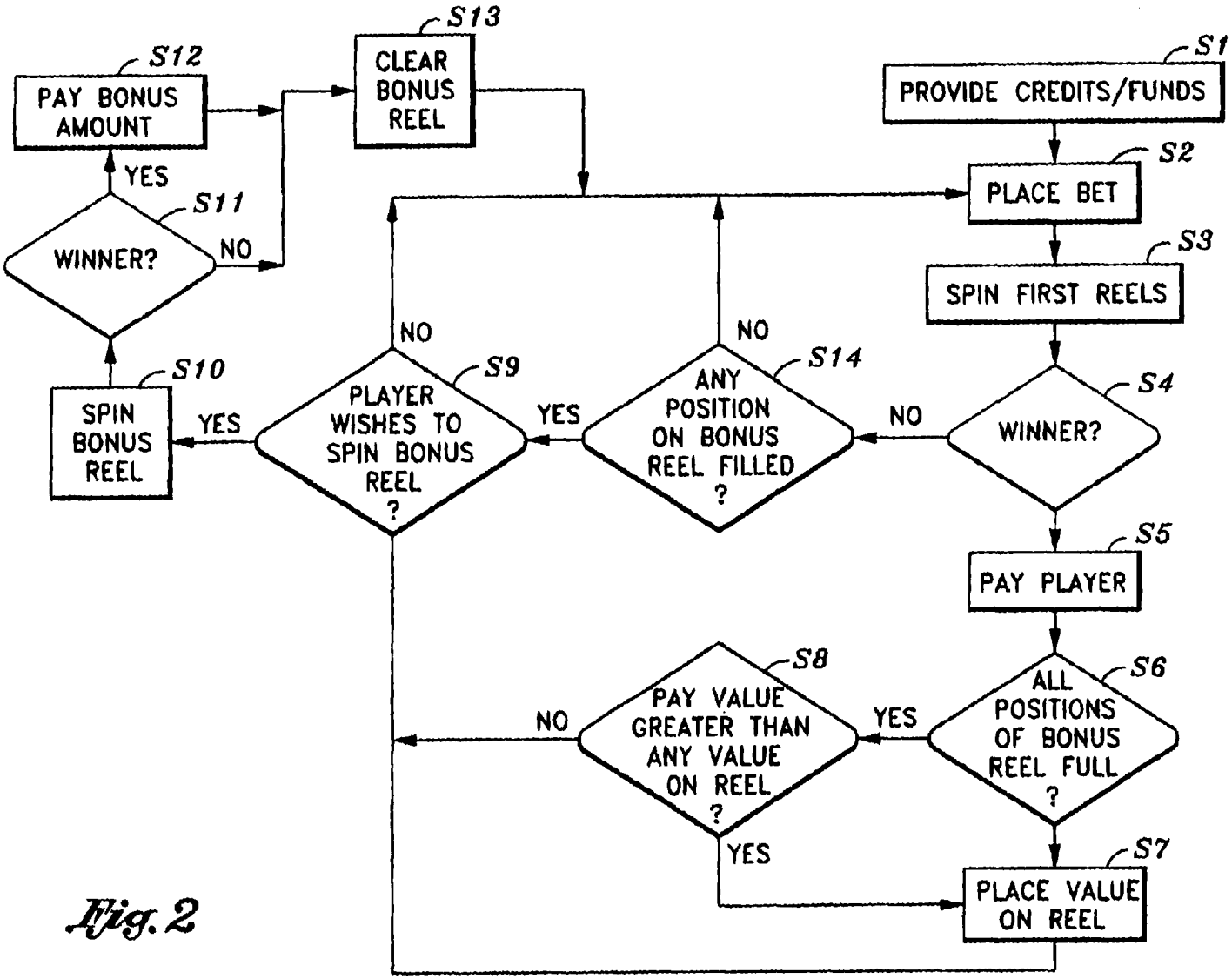
FIG. 2 is a flow diagram illustrating a method of playing a game in accordance with an embodiment of the present invention.

Referring to FIG. 2, in a preferred embodiment of the invention, in a first step S1, a player provides monetary input, such as by inserting coins to the coin acceptor 30, bills to the bill acceptor 32, or the like. Next, in a step S2, the player places a wager or bet. In one or more embodiments, this may be accomplished by the player depressing one or more times the bet credit button 34, or pressing the bet max button 35.

In a step S3, the player is permitted to spin the main game reels 22. In one embodiment, when the player depresses the "spin" button 28 or pulls the spin arm 26, the reels 22 are caused to spin, as described above. The reels 22 then stop (or are caused to stop), with each reel displaying an indicia 22 associated with the pay line 25. It is noted that the term "spin" as used herein is not limited to actual rotation of the reels. For example, a "spin" may result when a controller is caused to display a reel and indicia associated therewith on a display. In general, the term "spin" simply means a triggering event for causing the indicia to be randomly presented.

In a step S4, it is determined if the main game reels 22 display a winning combination of indicia 22. As described above, such comprises comparing the indicia 22 which are associated with the pay line 25 with predetermined winning combinations of indicia.

If the player has received a winning combination, then in a step S5, the player is paid the winnings. The payout may be paid in coins, such as through the coin tray 36, or as credits which the player may then bet using the bet credits and bet max buttons 34,35 or which the player may elect to have paid by pressing the cash out button 38.

In a step S6, it is determined if all of the positions associated with the bonus reel 40 for displaying indicia 42 are full. If not, then in a step S7, the amount won or paid to the player for receiving a winning combination on the main game reels 22 is associated with the bonus reel 40. As described above, there are a variety of means by which such indicia may be displayed by the reel 40. In one or more embodiments, in this step the bonus reel 40 is rotated to a position in which it displays a location not yet occupied by an indicia 42, and then the new indicia 42 is displayed thereon. In this manner, the player is permitted to view the addition of the newest winning amount to the bonus reel 40. As described above, the displaying of the indicia 42 may be associated with a mechanical reel or simply a video display of a reel.

If in step S6 all of the positions for indicia 42 associated with the bonus reel 40 are full, then it is determined in a step S8 if the amount won or paid to the player is greater than any of the values already associated with the bonus reel 40. For example, if the player just won 50 credits and one of the indicia 42 associated with the bonus reel 40 was 25 credits, then the answer to this inquiry would be yes. If the new amount exceeds any amount currently associated with the bonus reel 40, then in step S7, the new amount is added to the reel 40. More particularly, the new amount is used to replace any one indicia 42 associated with the bonus reel 40 which is less than the new amount. Again, the reel 40 may be rotated to the position of the indicia 42 which is to be replaced, and then be replaced in a manner permitting the player to view the replacement.

In a preferred embodiment, the player may be permitted to select the position on the bonus reel 40 which the player would like to associated an award with. For example, the player may be permitted, after winning the main game, to rotate the bonus reel 40 with a selector to any one of the positions which are unfilled on the bonus reel 40. The player may then press an "enter" or similar button or provide other input which causes the award value from the main game to be associated with that particular position on the bonus reel 40. While such does not allow the player to change the real odds of the bonus event, it permits the player to have more perceived control over the bonus event.

In a preferred embodiment, a bonus display 50 is provided which is capable of displaying each of the positions of the bonus reel 40. The bonus display 50 displays a duplicate of each position of the bonus reel 40 and any indicia associated with those positions. In this manner, a player can readily identify how many of the positions of the bonus reel 40 are filled, and with what award values. This display 50 may be of a variety of types, such as an LCD display.

In one embodiment, the display 50 may be integrated into and comprise a portion of the bonus reel 40. For example, in an arrangement where the bonus reel 40 is presented by a video display, when the bonus reel 40 is not being spun, each of the positions of the reel 40 may be displayed in similar fashion to that of display 50. In one embodiment, the positions are all illustrated in a vertical column. Of course, any indicia associated with a position is also illustrated. When the player wishes to spin the bonus reel 40, the column of displayed positions are transformed (by video transformation) into a displayed spinning reel. In this fashion, the player sees all of the positions of the reel and associated indicia during play of the main game, but when play of the bonus event occurs, the player views a reel.

In step S8 if the new winning amount is not greater than any current amount associated with the bonus reel 40, then the amounts associated with the reel are not changed. Information to this effect may be displayed to the player, such as "Bonus Reel Full of Higher Amounts. Do you Wish to Spin?" In such event, or after an indicia 42 is associated with the bonus reel 40 in step S7, it is determined in a step S9 if the player wishes to spin the bonus reel 40. In the arrangement of the apparatus 20 illustrated in FIG. 1, such may be indicated by the player pressing the spin bonus reel button 46.

If the player does not wish to spin the bonus reel 40, then the game sequence returns to step S2, with the player being required to place a bet to continue the game. If the player wishes to spin the bonus reel 40, then in a step S10, the bonus reel 40 spins.

In a step S11, it is then determined if the player has received a winning event based on the spin of the bonus reel 40. In a preferred embodiment, the player is declared the winner if the player receives any indicia 42, including the "win all" indicia 44. As described above, a winning indicia may be indicated when an indicia 42 is aligned with the pay line 48. Of course, the bonus reel 40 may stop at a location associated with the pay line 48 which is not occupied or filled with an indicia 42. In such event, the player is not a winner of the bonus game.

In a step S12, if the player wins the bonus game, then the player is paid the winnings. In one or more embodiments, the winnings comprise the amount associated with the bonus reel 40 which was aligned with the pay line 48. As described above, these amounts preferably comprise previous winning amounts from the main game. In addition, the player may win the "win all" amount, in which case the player is paid the total of all of the indicia 42 associated with the bonus reel 40. In this step, the player may be paid the winnings in coins, credits or by other means known in the art.

Whether or not the player won or lost the bonus game, in a step S13, the indicia 42 associated with the reel 40 are removed (i.e. disassociated) therefrom. In a preferred embodiment, the "win all" indicia 44 is retained on the reel 40 at all times, however, since without any other indicia associated with the bonus reel 40, the "win all" would comprise no win.

Referring again now to step S4, if the player was not a winner of the main game, then in a step S14 it is determined if any of the locations on the bonus reel 40 are filled with indicia 42 other than the "win all" indicia 44. In other words, it is determined if the present or a previous player at some point won the main game. If not, then the player is prompted to bet one or more credits to play the main game in order to continue, returning to step S2. If so, then the player is entitled to try and win the bonus game by spinning the bonus reel 40 in step S9. In such event, play continues as described above.

An example of the play of a game in accordance with the above-method will now be described with reference to FIGS. 3(*a*)–(*d*). First, a player inserts money for playing the game. The player then places a bet and spins the main game reels 22. Presume that the player receives the combination of indicia comprising the symbols of a star, moon, and sun (see FIG. 3(*a*)) and this is a non-winning combination. The player is declared a loser and it is next determined if the player is entitled to.play the bonus game. Since the player has not yet won the main game, unless one or more indicia 42 are associated with the bonus reel 40 from a prior game to played by another player, then the player is not permitted to play the bonus game. Presuming such (for example, if the previous player of the apparatus spun the bonus reel on their last play, then all of the indicia would have been removed from the bonus reel 40 in step S13 and the bonus reel is empty except for the "win all" indicia 44, as illustrated in FIG. 3(*a*)), then the player must place another bet to continue.

Figures 3A, 3B, 3C, 3D:
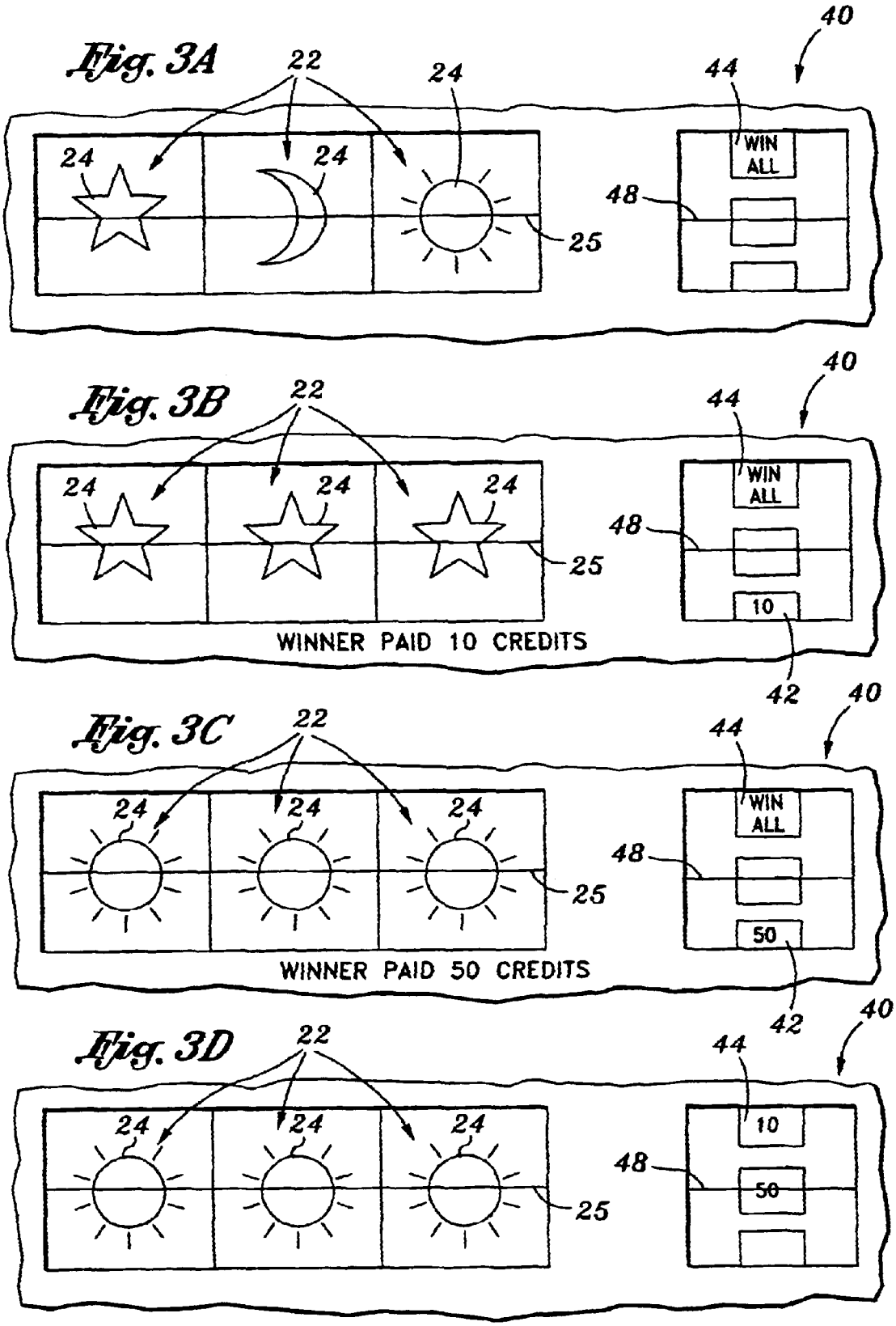
FIG. 3(*a*) illustrates indicia displayed by reels of a game being played in accordance with the invention after a first spin of the main game reels.

Presume that in the next spin the player received the combination of three stars on the main game reels 22, and that this combination entitled the player to a winning of 10 credits, as illustrated in FIG. 3(*b*). The player is paid this amount and then the value "10" is associated with one of the locations or positions on the bonus reel 40. Next, the player is entitled to spin the bonus reel 40. The player elects not to, but instead elects to continue to play the main game. Presume the player plays the game until he has received additional wins from the main game of 20 and 50 credits and these values have also been associated with the bonus reel 40, as illustrated in FIG. 3(*c*). Next assume that the player wishes to spin the bonus reel 40. At this time, the player has the opportunity of receiving no win, a win of 10, 20 or 50 credits, or a "win all," which comprises the total of all the values on the reel 40-in this case 10+20+50=80. Based on the outcome of the spin, as illustrated in FIG. 3(*d*), the player received a bonus win of 50 credits. The player is either not declared a winner or is a winner and paid the winning amount. As illustrated in FIG. 3(*d*), the player received a bonus win of 50 credits.

In one or more embodiments, when all of the positions on the bonus reel 40 are full, then no other amounts are associated with the reel (i.e. lower amounts are not replaced with higher amounts). In another embodiment, when all of the positions on the bonus reel 40 are full, then future winning amounts from the first game are used to randomly replace indicia already associated with the bonus reel 40.

Several aspects of the game of the present invention will now be appreciated. First, the invention is a game which has two primary components, a first main game or event and a additional, bonus event. Unlike prior games, however, in accordance with the invention, a player is automatically permitted to participate in the bonus event by receiving any winning combination of the main game, without having to place an additional wager and without risking the loss of any winnings previously paid in association with the main game.

As will be appreciated, if the player elects to spin the bonus reel 40 when only a single indicia 42 besides the win all indicia 44 is associated with the reel 40, then the player has only a low probability of winning the bonus game. In an example where the odds are true and the reel 40 has twelve locations, in the above-example the player's odds of winning would be two in twelve. As one aspect of the game of the invention, a player is enticed to play the main game a long period of time in an attempt to win it as many times as necessary to completely fill the bonus reel 40. Once the player has filled the bonus reel 40, then the player is assured that a spin of that reel 40 will result in a win of some amount.

Moreover, a player is enticed to play the main game in an attempt to not only fill the bonus reel 40, but to fill it with high winning amounts or payouts. As described above, once the bonus reel 40 is full, if the player continues to play the main game and obtains winning payouts, those payouts are compared to the values already on the bonus reel 40. If the later won amounts from the main game exceed the previous amounts, they are replaced. Thus, the player has the opportunity to play the main game to fill the bonus reel 40 with high winning values. Then, when the player plays the bonus event, that player has the opportunity to win much higher amounts.

As another aspect of the invention, a player may play the bonus event at any time after winning the main game at least once. Thus, if a player does not have sufficient time to play the main game to fill the bonus reel 40, the player may still at any time attempt to win the bonus event by spinning the reel 40. For example, a player may play the main game a short period of time before a table becomes available at a restaurant. When the player's table becomes available, the player need not simply leave his efforts, but can spin the bonus reel 40 and attempt to win whatever amounts the player had been able to place thereon by playing the main game.

In one or more embodiments, a player may be permitted to save a game state associated with the gaming apparatus 20. The player may play the game for some period of time, for example filling several of the spots on the bonus reel 40. The player may not desire to play the bonus game at that time, but may not have time to continue playing the main game in an attempt to fill the bonus reel 40. In a preferred embodiment, the player may be provided with a media having game state information associated therewith. As in the case of the player card 100 described above, the game state information may actually comprise game state data, or may comprise information for identifying game state information stored elsewhere, such as on a gaming apparatus or central computer. The stored game state information comprises that information which, when the player re-identifies themselves, such as with a card or code, the gaming apparatus 20 configures itself to the state of the game when the player previously quit playing.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of playing a game comprising:

accepting a wager;

presenting a main game comprising generating a set of indicia;

determining if the outcome of said main game is a winning outcome;

associating at least one indicia with said bonus event as a result of a winning outcome of said main game, said associated indicia representative of a winning amount;

playing a bonus event, said bonus event comprising the random selection of at least one indicia from a set of at least one indicia including said indicia which are associated with the bonus event as a result of winning outcomes of said main game and an indicia which represents the sum of said winning amounts represented by the associated indicia; and determining the outcome of said bonus event.

2. The method in accordance with claim 1 wherein said indicia representative of a winning amount comprise numerical win values.

3. The method in accordance with claim 2 wherein said numerical win values represent a number of coins.

4. The method in accordance with claim 2 wherein said numerical win values represent a number of credits.

5. The method in accordance with claim 1 wherein said indicia which represents the sum of said winning amounts represented by the other indicia comprises a win all indicia.

6. The method in accordance with claim 1 including the step of paying a winning amount if the outcome of said main game is a winning outcome.

7. The method in accordance with claim 1 including the step of paying a bonus amount if the outcome of said bonus event is a winning outcome.

8. The method in accordance with claim 1 wherein said step of presenting said main game comprises rotating a set of reels bearing indicia.

9. The method in accordance with claim 1 including the step of displaying said set of indicia associated with said bonus event on a display.

10. A method of playing a game comprising:

accepting a wager;

presenting a main game comprising generating a set of indicia;

determining if the outcome of said main game is a winning outcome;

displaying a plurality of bonus event positions on a display;

associating at least one indicia with said bonus event as a result of a winning outcome of said main game;

displaying said indicia associated with said bonus event in said bonus event positions;

permitting continued play of said main game to fill said bonus event positions;

permitting play of a bonus event at any time after acceptance of said wager, said play of said bonus event comprising the random selection of at least one indicia from a set of at least one indicia associated with the bonus event; and determining the outcome of said bonus event.

11. The method in accordance with claim 10 including the step of accepting input regarding a particular bonus event position with which to display an indicia associated with said bonus event.

12. The method in accordance with claim 10 including the step of replacing one or more displayed indicia with later associated indicia once all of said bonus event positions are filled.

13. The method in accordance with claim 12 wherein said associated indicia represent winning values and displayed indicia representing lower winning values are replaced with later associated indicia representing higher winning values.

14. The method in accordance with claim 12 including the step of receiving input from a player activating play of said bonus event.

15. The method in accordance with claim 12 wherein play of said bonus event occurs after all of said bonus event positions are filled.

16. The method in accordance with claim 10 wherein said step of presenting a main game comprises rotating a plurality of reels bearing indicia.

17. The method in accordance with claim 10 wherein said display comprises a rotatable reel.

* * * * *